US008032060B2

(12) United States Patent
Jeon

(10) Patent No.: US 8,032,060 B2
(45) Date of Patent: Oct. 4, 2011

(54) POWER TRANSMITTING UNIT, AND DEVELOPING DEVICE AND IMAGE FORMING APPARATUS HAVING THE SAME

(75) Inventor: In-cheol Jeon, Yongin-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 676 days.

(21) Appl. No.: 12/037,187

(22) Filed: Feb. 26, 2008

(65) Prior Publication Data

US 2009/0067883 A1 Mar. 12, 2009

(30) Foreign Application Priority Data

Sep. 11, 2007 (KR) ..... 10-2007-0091999

(51) Int. Cl.
*G03G 15/06* (2006.01)
*G03G 15/00* (2006.01)

(52) U.S. Cl. ..... 399/222; 399/167

(58) Field of Classification Search ..... 399/222, 399/167, 119

See application file for complete search history.

(56) References Cited

U.S. PATENT DOCUMENTS 6,173,145 B1 * 1/2001 Chadani et al. ..... 399/265
2008/0138115 A1 * 6/2008 Chadani et al. ..... 399/167

OTHER PUBLICATIONS

Machine translation of Kanekura (Pub No. JP 09-114,160 A) Pub date May 2, 1997.*

* cited by examiner

*Primary Examiner* — David Gray
*Assistant Examiner* — Rodney Bonnette
(74) *Attorney, Agent, or Firm* — Stanzione & Kim, LLP

(57) ABSTRACT

An image forming apparatus includes a main body in which a photosensitive medium is disposed, and a developing device detachably disposed at the main body to develop electrostatic latent images on the photosensitive medium. The developing device includes a developing member disposed in a developing unit to supply developing agent to the photosensitive medium, a driven member to receive power from a driving member, and to allow the developing member to rotate, and a power transmitting member to connect the developing member and the driven member, and to absorb a movement of a normal force direction of a driving force generated between the driving member and the driven member.

21 Claims, 8 Drawing Sheets

FIG. 1
(CONVENTIONAL)
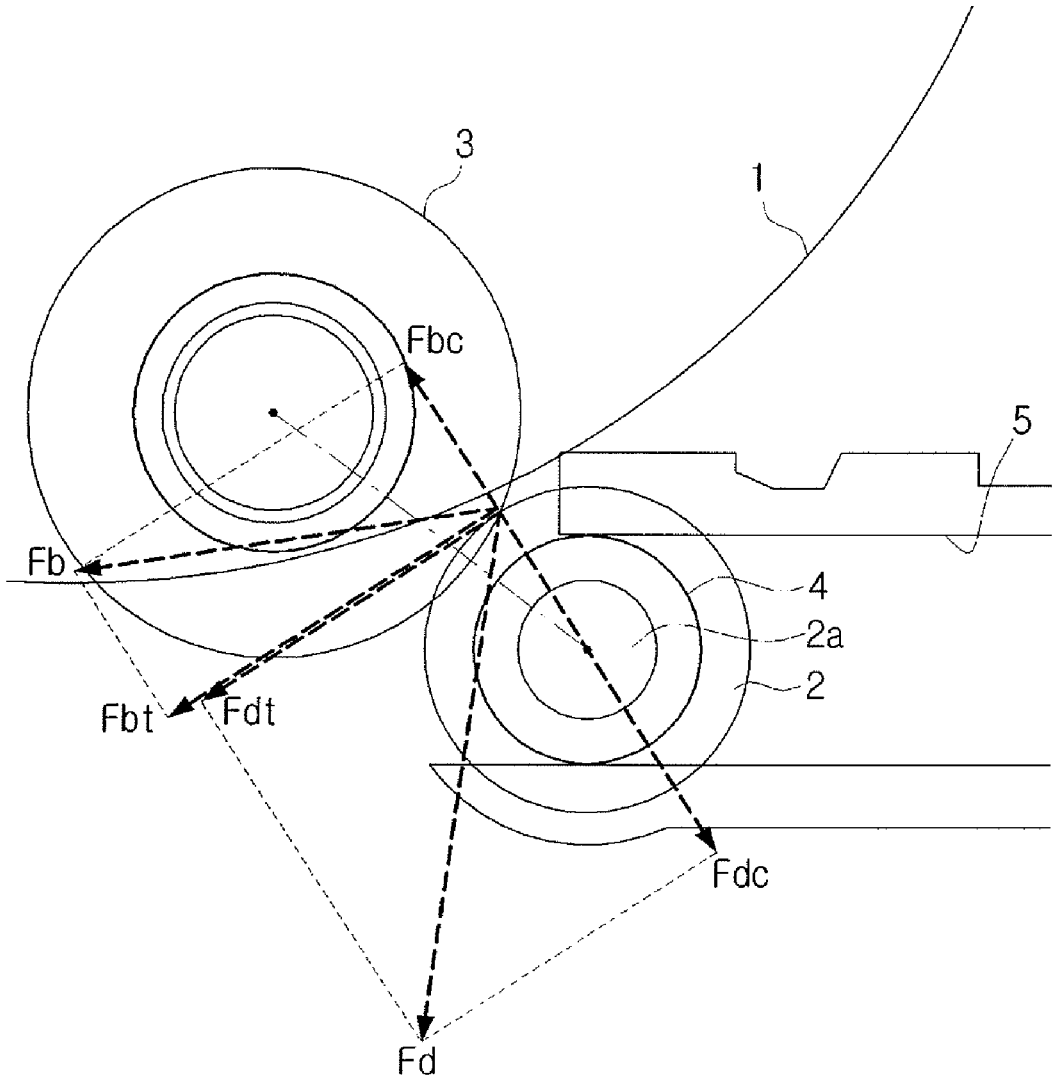

POWER TRANSMITTING UNIT, AND DEVELOPING DEVICE AND IMAGE FORMING APPARATUS HAVING THE SAME

CROSS-REFERENCE TO RELATED APPLICATIONS

This application claims priority under 35 U.S.C. §119(a) from Korean Patent Application No. 2007-91999 filed Sep. 11, 2007 in the Korean Intellectual Property Office, the disclosure of which is incorporated herein by reference in its entirety.

BACKGROUND OF THE INVENTION

1. Field of the Invention

The present general inventive concept relates to an image forming apparatus. More particularly, the present general inventive concept relates to a power transmitting unit to transmit power between two members, and a developing device and an image forming apparatus having the same.

2. Description of the Related Art

Generally, conventional image forming apparatuses such as a printer, a copier, a facsimile machine, and a composite apparatus have all functions thereof have a printing function to print images on a printing medium. The image forming apparatuses have a printing medium feeding unit, a photosensitive medium, a developing device, a transferring unit, a fusing unit, and a conveying unit. Alternatively, a color image forming apparatus needs the developing device having a plurality of developing units for forming color images.

The color image forming apparatus has first to fourth developing units to store yellow, magenta, cyan, and black toners, respectively. The first to fourth developing devices have first to fourth developing members to face the photosensitive medium. Each of the first to fourth developing members has a gap ring disposed at one side thereof to maintain a gap between the photosensitive medium and the developing member. Each of the first to fourth developing units is biased toward the photosensitive medium by an elastic member disposed at a rear side of each of the developing units.

The first to fourth developing members receive a driving force from first to fourth driving members disposed in a main body of the image forming apparatus, and are driven. For this, first to fourth driven members engaging with the first to fourth driving members are coaxially disposed at the first to fourth developing members, respectively. Each of the first to fourth developing members rotates counterclockwise, and the photosensitive medium rotates clockwise.

The first to fourth developing units having the above-described structure are vertically arranged at one side of the photosensitive medium by predetermined intervals. At this time, the first to fourth developing units are guided along mounting rails disposed in the main body of the image forming apparatus, so mounted to the main body of the image forming apparatus so that each of the first to fourth driven members are engaged with each of the first to fourth driving members. Also, each of the first to fourth driven members has a mounting projection to be inserted into the mounting rail at one side thereof.

Alternatively, forces operating between the fourth driven member and the fourth driving member of the fourth developing unit that is disposed to face the photosensitive medium at a lower position compared to the first to third developing units are resolved as illustrated in FIG. 1.

Referring to FIG. 1, Fd is a driving force to operate between the fourth driven member 4 and the fourth driving member 3 engaging with each other, and Fb is an elastic pressing force to push the fourth developing unit toward the photosensitive medium 1 from a rear side of the fourth developing unit. Each of the driving force Fd and elastic pressing force Fb is resolved into a tangential force Fdt and Fbt and a normal force Fdc and Fbc between the fourth driven member 4 and the fourth driving member 3. A reference numeral 5 is a mounting rail.

The two normal forces Fdc and Fbc to determine a developing nip between the developing member 2 and the photosensitive medium 1 operate in opposite direction. The normal force Fdc caused by the driving force Fd is larger than the normal force Fbc caused by the elastic pressing force Fb. Therefore, the fourth driven member 4 moves in a direction of the Fdc. Because the fourth driven member 4 and fourth developing member 2 are disposed at the same shaft 2*a*, a developing nip between the photosensitive medium 1 and the fourth developing member 2 is changed so that developing quality is likely to degrade.

Alternatively, because an outer surface of the photosensitive medium 1 is formed in an ellipse section not a circle section, the fourth developing member 2 is required to move within a predetermined range for uniformly maintaining the developing nip between the photosensitive medium 1 and the developing member 2. If the movement of the fourth developing member 2 is transmitted to the fourth driven member 4 disposed at the same shaft 2*a* with the fourth developing member 2, the movement of the fourth developing member 2 impedes engagement between the fourth driving member 3 and the fourth driven member 4.

Also, the two tangential forces Fdt and Fbt resolved from the driving force Fd and the elastic pressing force Fb cause the fourth driven member 4 to move toward a bottom end of the photosensitive medium 1. As a result, a distance between a shaft of the fourth driven member 4 and a shaft of the fourth driving member 3 is unstable.

SUMMARY OF THE INVENTION

The present general inventive concept provides a power transmitting unit to prevent movement of a first member from being transmitted to a second member during operation, and a developing device and an image forming apparatus having the same.

Additional aspects and utilities of the present general inventive concept will be set forth in part in the description which follows and, in part, will be obvious from the description, or may be learned by practice of the general inventive concept.

The foregoing and/or other aspect and utilities of the present general inventive concept can substantially be achieved by providing a developing device, which includes a developing member disposed in a developing unit to supply developing agent to a photosensitive medium, a driven member to receive power from a driving member and to allow the developing member to rotate, and a power transmitting member to connect the developing member and the driven member, and to absorb a movement of a normal force direction of a driving force generated between the driving member and the driven member.

The power transmitting member may include a coupler having first and second connecting grooves formed to intersect each other on first and second surfaces thereof, and first and second connecting protrusions formed on a shaft of the developing member and a shaft of the driven member are inserted in the first and second connecting grooves.

Here, the first and second connecting grooves and the first and second connecting protrusions may have a section formed substantially in a rectangular shape.

The first and second connecting grooves may be perpendicular to each other.

Predetermined moving gaps may be formed between the first and second connecting protrusions and the first and second connecting grooves.

The developing unit may be mounted along a mounting rail disposed in a main body, and biased to the photosensitive medium by an elastic member.

Furthermore, the developing device according to an exemplary embodiment of the present general inventive concept may further include a first supporting portion to support opposite shaft portions of the driven member to support a movement of the driven member caused by a tangential force of the driving force generated between the driven member and the driving member.

The first supporting portion may include a first stopping surface to contact a first stopping protrusion formed in the main body to face the tangential force of the driving force, and a second stopping surface to contact a second stopping protrusion formed in the main body to face an elastic pressing force of the elastic member.

Also, the developing device may further include a second supporting portion to support the developing unit and be connected with the first supporting portion.

The first supporting portion may include a supporting rail in which a supporting projection to project from the second supporting portion is inserted, and the supporting rail may be formed to be inclined to the photosensitive medium.

The foregoing and/or other aspects and utilities of the present general inventive concept can also be achieved by providing an image forming apparatus, which includes a main body in which a photosensitive medium is disposed, and a developing device detachably disposed at the main body to develop electrostatic latent images on the photosensitive medium, the developing device may include a developing member disposed in a developing unit to supply developing agent to the photosensitive medium, a driven member to receive power from a driving member and to allow the developing member to rotate, and a power transmitting member to connect the developing member and the driven member, and the power transmitting member to absorb a movement of a normal force direction of a driving force generated between the driving member and the driven member.

The foregoing and/or other aspects and utilities of the present general inventive concept can also be achieved by providing an image forming apparatus, which includes a main body in which a photosensitive medium is disposed, and a developing device detachably disposed at the main body to develop electrostatic latent images on the photosensitive medium, the developing device may include a developing member disposed in a developing unit to supply developing agent to a photosensitive medium, a driven member to receive power from a driving member and to allow the developing member to rotate, a power transmitting member to connect the developing member and the driven member, and to absorb a movement of a normal force direction of a driving force generated between the driving member and the driven member, and a first supporting portion to support opposite shaft portions of the driven member to support a movement of the driven member caused by a tangential force of the driving force generated between the driven member and the driving member.

The foregoing and/or other aspects and utilities of the present general inventive concept can also be achieved by providing a power transmitting unit, which may include a driving member, a driven member driven by the driving member, and a coupler to connect the driving member and the driven member and to absorb movement of at least one of the driving member and the driven member. The coupler may be provided with first and second connecting grooves formed to be perpendicular to each other on first and second surfaces of the coupler, in which protrusions formed on a shaft of the developing member and a shaft of the driven member are movably inserted.

The foregoing and/or other aspects and utilities of the present general inventive concept can also be achieved by providing a power transmitting unit to connect a developing roller to supply a photosensitive medium with developing agent and a developing gear engaged with a driving gear in an axial direction. The power transmitting unit may include first and second connecting protrusions formed in a non-circular shape on each of a shaft of the developing roller and a shaft of the developing gear, and a coupler member to have first and second connecting grooves in which the first and second connecting protrusions are inserted, and that are formed on first and second surfaces of the coupler member, wherein predetermined moving gaps are formed between the first and second connecting protrusions and the first and second connecting grooves.

The foregoing and/or other aspects and utilities of the present general inventive concept can also be achieved by providing a power transmitting unit, which may include a driving member, a driven member driven by the driving member, and a coupler disposed between the driving member and the driven member to connect the driving member and the driven member and to absorb movement of at least one of the driving member and the driven member, wherein the coupler receives a driving force from the driving member via two driving points or the coupler transmits the driving force to the driven member via two driven points.

The foregoing and/or other aspects and utilities of the present general inventive concept can also be achieved by providing a power transmitting unit to connect a developing roller to supply a photosensitive medium with developing agent and a developing gear engaged with a driving gear in an axial direction. The power transmitting unit may include a first connecting protrusion formed on a shaft of the developing roller, a second connecting protrusion formed on a shaft of the developing gear, and a coupler member to have first and second connecting grooves in which the first and second connecting protrusions are movably inserted, and that are formed on first and second surfaces of the coupler member, wherein the coupler member receives a driving force from the second connecting protrusion via two driving points, and transmits the driving force to the first connecting protrusion via two driven points.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which:

FIG. 1 is a sectional view schematically illustrating a resolution of a driving force generated between a driven member and a driving member and a resolution of an elastic pressing force generated by an elastic member in a conventional image forming apparatus;

DETAILED DESCRIPTION OF THE PREFERRED EMBODIMENTS

Figure 2:
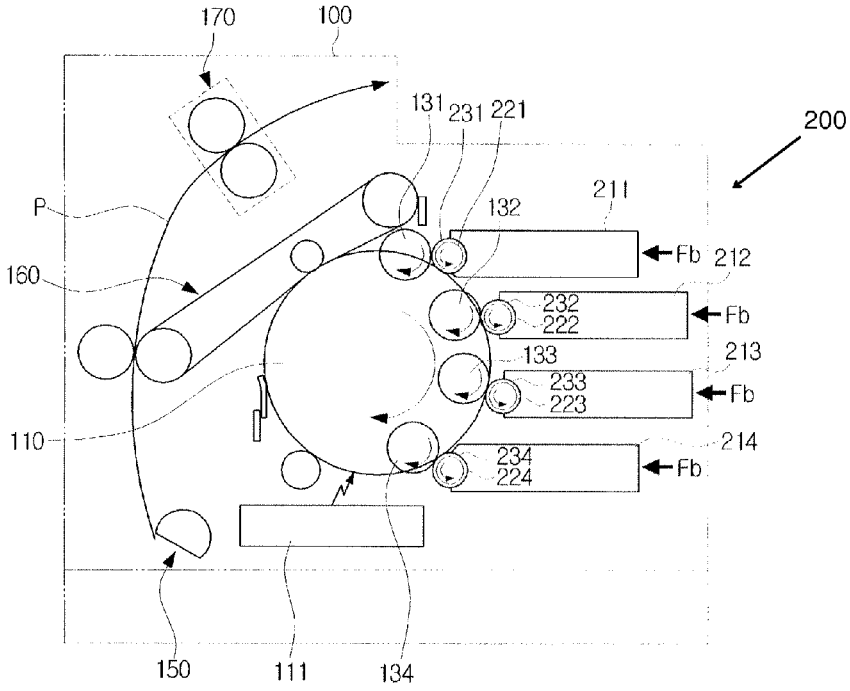
FIG. 2 is a configuration diagram schematically illustrating an image forming apparatus according to an exemplary embodiment of the present general inventive concept.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

The matters defined in the description, such as a detailed construction and elements thereof, are provided to assist in a comprehensive understanding of the present general inventive concept. Thus, it is apparent that the present inventive concept may be carried out without those defined matters. Also, well-known functions or constructions are omitted to provide a clear and concise description of exemplary embodiments herein.

Figure 3:
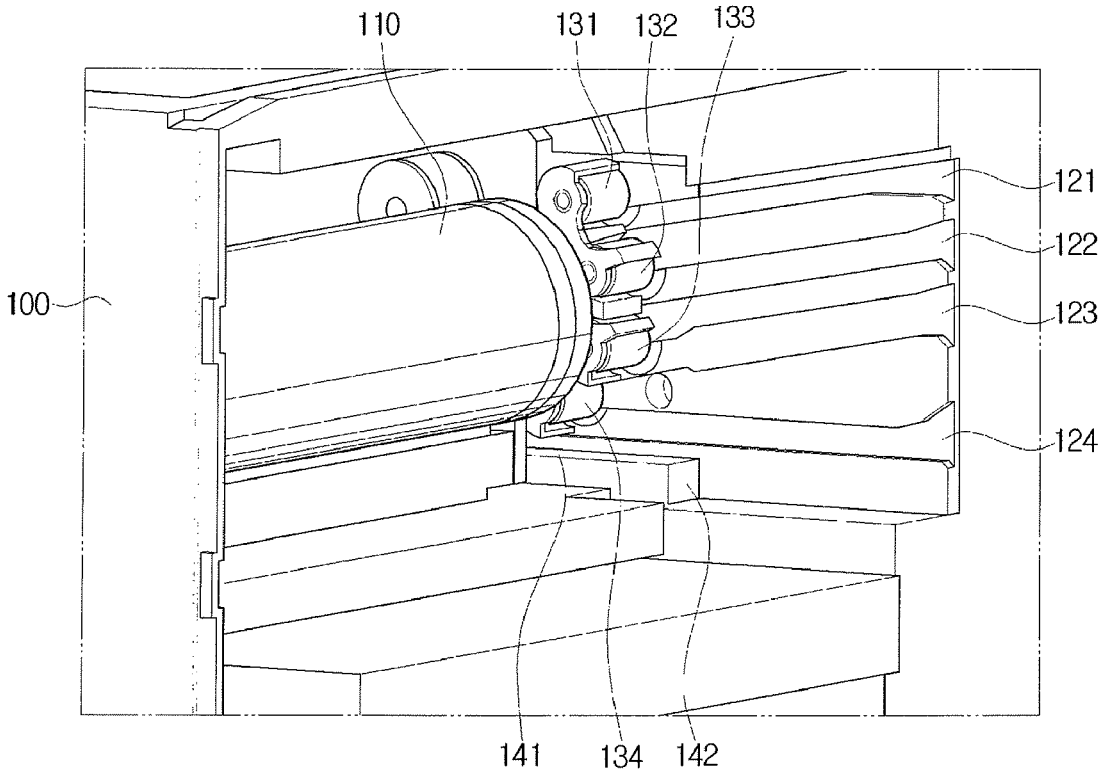
FIG. 3 is a partial perspective view illustrating a main body of an image forming apparatus without a developing device according to an embodiment of the present general inventive concept.
Figure 4:
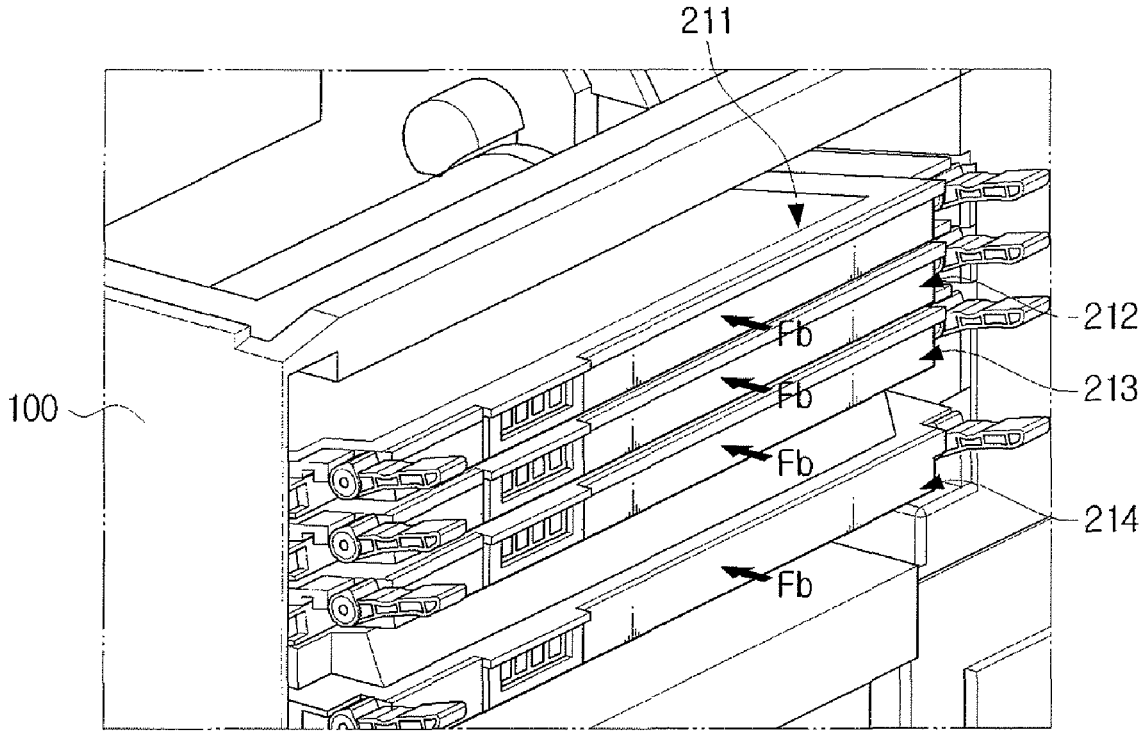
FIG. 4 is a partial perspective view illustrating a main body of an image forming apparatus with a developing device according to an embodiment of the present general inventive concept.

Referring to FIGS. 2 to 4, an image forming apparatus according to various embodiments of the present general inventive concept includes a main body 100 and a developing device 200.

A photosensitive medium 110 on which an exposure unit 111 exposes to form electrostatic latent images is disposed inside the main body 100 of the image forming apparatus. Also, portions for printing images on a printing medium P, that is, a printing medium feeding unit 150 to feed the printing medium P, a transferring unit 160 to transfer a developed image onto the printing medium P, and a fusing unit 170 to fuse the image on the printing medium P are disposed inside the main body 100 of the image forming apparatus. Furthermore, a driving unit such as a driving motor to drive the portions is disposed in the main body 100.

The developing device 200, as illustrated in FIGS. 2 and 4, is disposed inside the main body 100 of the image forming apparatus. The developing device 200, as illustrated in FIGS. 2, and 4 to 6, includes first to fourth developing units 211, 212, 213, and 214, first to fourth developing members 221, 222, 223, and 224, first to fourth driven members 231, 232, 233, and 234, a power transmitting member 240, and a first supporting portion 250.

The first to fourth developing units 211, 212, 213, and 214 holds a developing agent. For example, in this exemplary embodiment, to form color images, the first to fourth developing units 211, 212, 213, and 214 hold yellow, magenta, cyan, and black developing agents, respectively. Each of the first to fourth developing units 211, 212, 213, and 214 is detachably disposed at the main body 100 of the image forming apparatus. The first to fourth developing units 211, 212, 213, and 214 are vertically in order at one side of the photosensitive medium 110.

First to fourth mounting rails 121, 122, 123, and 124 to guide mounting of the first to fourth developing units 211, 212, 213, and 214 are disposed on an inner wall of the main body 100 as illustrated in FIGS. 3 and 4. The mounting order and position of each of the first to fourth developing units 211, 212, 213, and 214, however, is not limited as the above description.

Each of the first to fourth developing members 221, 222, 223, and 224 is disposed at each of the first to fourth developing units 211, 212, 213, and 214 to face the photosensitive medium 110. Here, each of the first to fourth developing members 221, 222, 223, and 224 is a rotatable roller.

Figure 5:
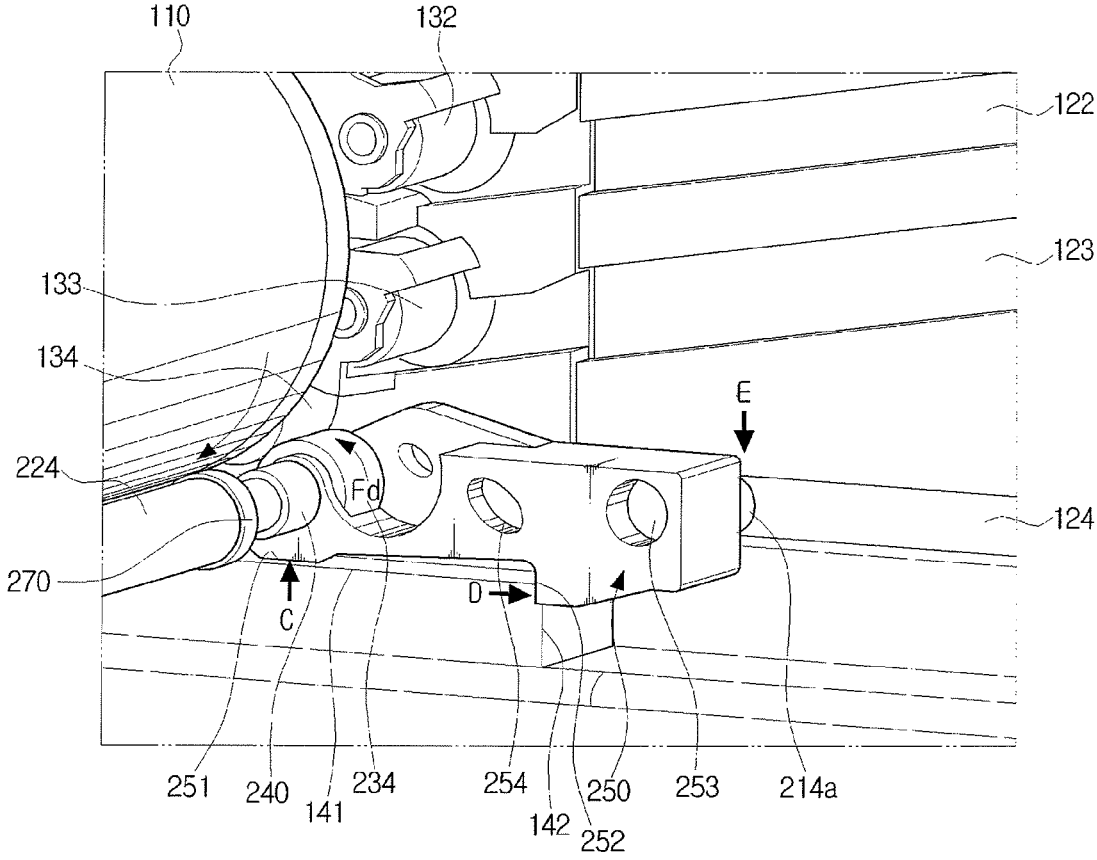
FIG. 5 is a partial perspective view illustrating a fourth developing member, which has a fourth driven member, a power transmitting member, and first and second supporting portions, and is mounted to a main body of an image forming apparatus according to an embodiment of the present general inventive concept.
Figure 9:
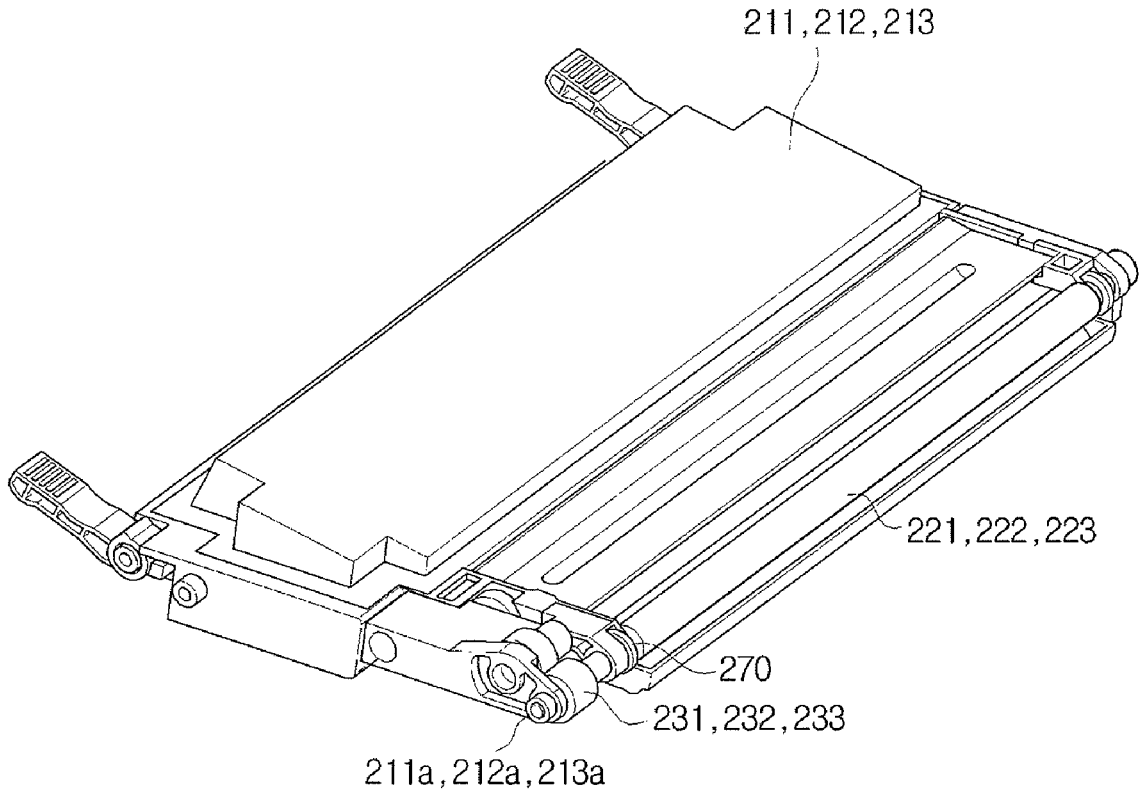
FIG. 9 is a perspective view illustrating a developing unit used as first to third developing units according to an embodiment of the present general inventive concept.

There are predetermined developing nips between the first to fourth developing members 221, 222, 223, and 224 and the photosensitive medium 110. The developing agent moves within the developing nips via a difference of electric potential. A gap ring 270 is disposed to contact the photosensitive medium 110 at one side of each of the first to third developing members 221, 222, 223, and 224 as illustrated in FIGS. 5 and 9, thereby forming the developing nip.

As illustrated in FIG. 2, the first to fourth developing units 211, 212, 213, and 214 are biased toward the photosensitive medium 110 by elastic pressing forces Fb so that the developing nips between the first to fourth developing members 221, 222, 223, and 224 and the photosensitive medium 110 are uniformly maintained. Although not illustrated, elastic members such as a spring that press the rear ends of the first to fourth developing units 211, 212, 213, and 214 are disposed in the main body 100 of the image forming apparatus.

Each of the first to fourth driven members 231, 232, 233, and 234 is coupled to one side of each of the first to fourth developing members 221, 222, 223, and 224 to transmit a driving force. Here, explanations of the first to third driven members 231, 232, and 233 refer to FIG. 9, and explanations of the fourth driven member 234 refer to FIGS. 5 to 8. The first to fourth driven members 231, 232, 233, and 234, as illustrated in FIGS. 3 and 5, are connected to the first to fourth driving members 131, 132, 133, and 134, which are disposed in the main body 100 and driven by the driving force of the main body 100 of the image forming apparatus, to be driven.

Here, the first to fourth driving members 131, 132, 133, and 134 are gears to receive the driving force from a driving source (not illustrated) disposed in the main body 100 of the image forming apparatus via a plurality of gear trains, and the first to fourth driven members 231, 232, 233, and 234 are also gears.

Figure 6:
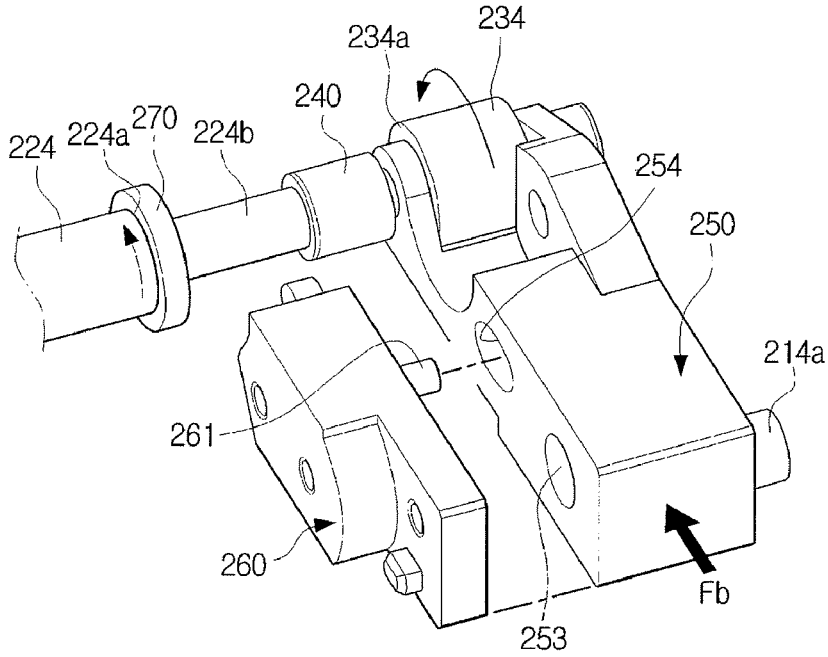
FIG. 6 is a partial perspective view illustrating a power transmitting member, and first and second supporting portions according to an embodiment of the present general inventive concept.
Figure 7:
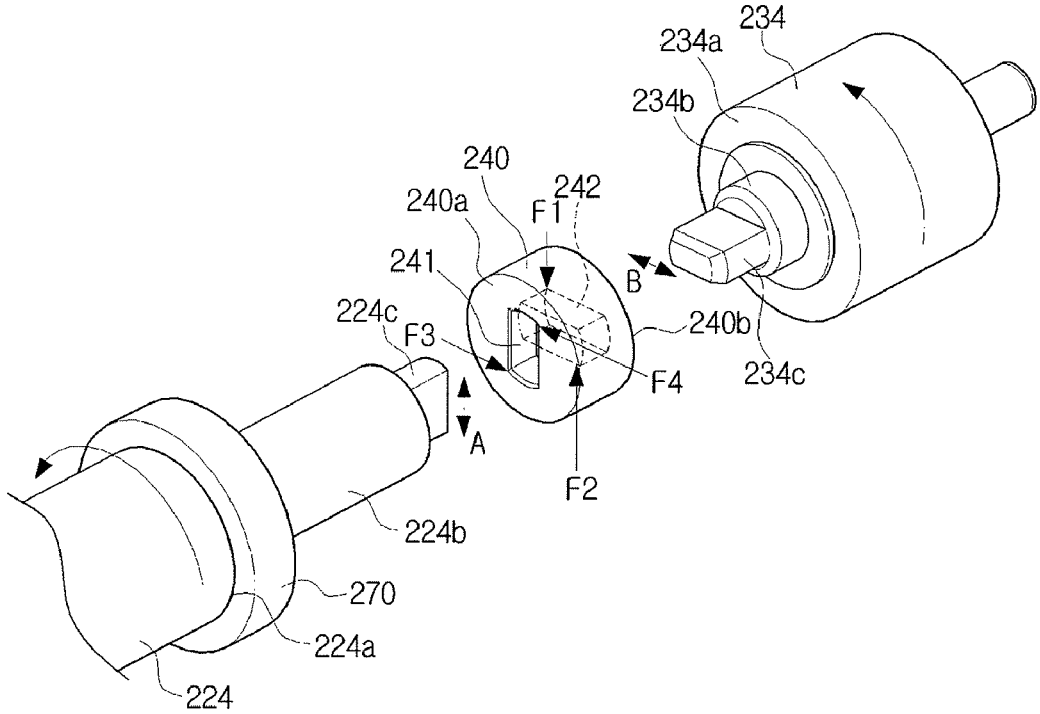
FIG. 7 is a partial exploded perspective view illustrating a fourth developing member, a fourth driven member, and a power transmitting member according to an embodiment of the present general inventive concept.
Figure 8:
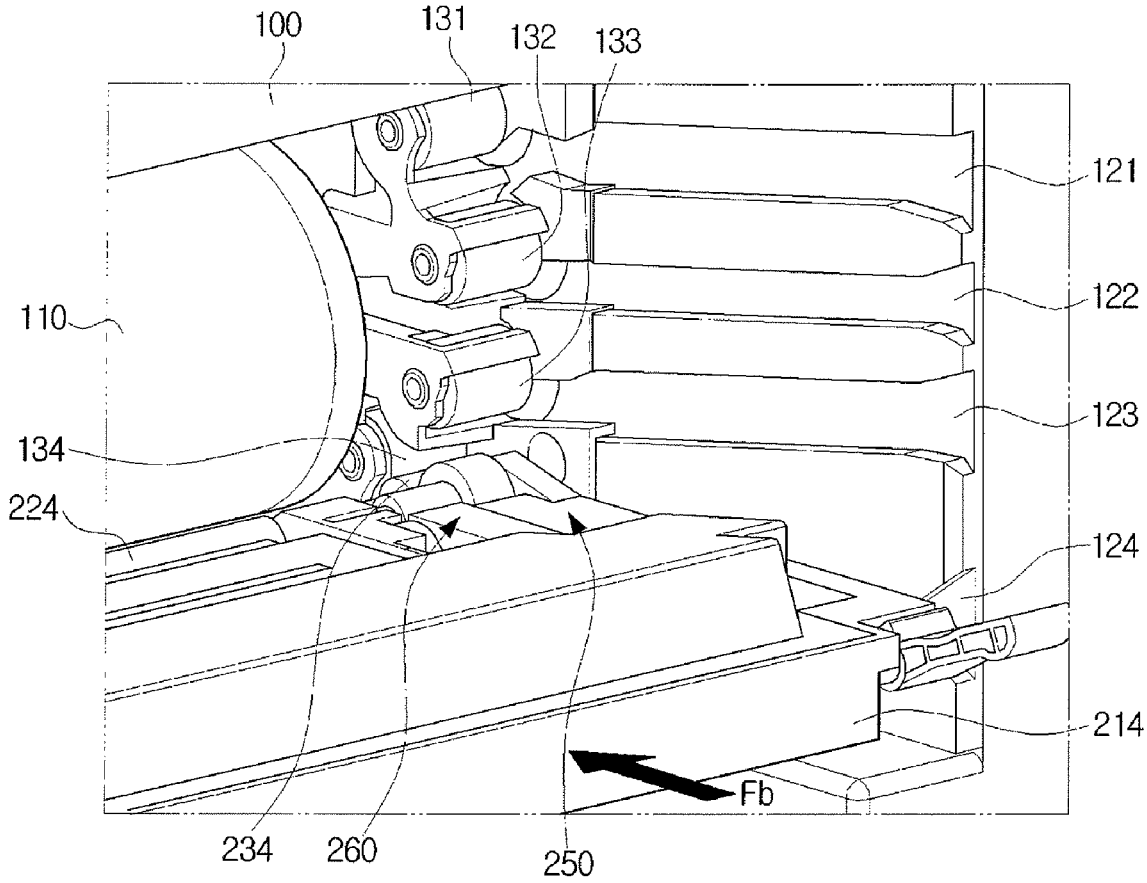
FIG. 8 is a partial perspective view illustrating a fourth developing unit mounted to a main body of an image forming apparatus according to an embodiment of the present general inventive concept.

The power transmitting member 240, as illustrated in FIGS. 6 and 7, is disposed between the fourth developing member 224 and the fourth driven member 234 to absorb the movement of the normal force Fdc direction (see FIG. 1) of the driving force generated between the fourth driven member 234 and the fourth driving member 134.

Alternatively, in this exemplary embodiment, the power transmitting member 240 is disposed at the fourth developing unit 214 that is disposed below the photosensitive medium 110. However, this does not limit a position in which the power transmitting member 240 is disposed. The power transmitting member 240 can be disposed at various positions to absorb the movement of the normal force Fdc direction of the driving force generated between the driven members 231, 232, 233, and 234 and the driving members 131, 132, 133, and 134 according to a position relationship between the photosensitive medium 110 and the developing units 211, 212, 213, and 214.

Alternatively, regardless of the position relationships between the photosensitive medium 110 and the first to fourth developing units 211, 212, 213, and 214, the power transmitting member 240 can be disposed all between the first to fourth driven members 231, 232, 233, and 234 and the first to fourth developing members 221, 222, 223, and 224.

Referring to FIG. 7, the power transmitting member 240 is provided with first and second connecting grooves 241 and 242 that are formed on a first surface 240*a* and a second surface 240*b* thereof to intersect each other, respectively. First and second connecting protrusions 224*c* and 234*c* projecting from a surface 224*a* and 234*a* of each of the fourth developing member 224 and the fourth driven member 234 to face each other are inserted in the first and second connecting grooves 241 and 242.

In detail, the first surface 240*a* of the power transmitting member 240 faces the surface 224*a* of the fourth developing member 224, and the first connecting protrusion 224*c* projecting from a shaft 224*b* of the fourth developing member 224 is inserted in the first connecting groove 241 formed on the first surface 240*a* of the power transmitting member 240. That is, the power transmitting member 240 is a coupler having the first and second connecting grooves 241 and 242 in which each of the first and second connecting protrusions 224*c* and 234*c* is inserted.

Also, the second surface 240*b* of the power transmitting member 240 faces the surface 234*a* of the fourth driven member 234, and the second connecting protrusion 234*c* projecting from a shaft 234*b* of the fourth driven member 234 is inserted in the second connecting groove 242 formed on the second surface 240*b* of the power transmitting member 240.

Here, the first and second connecting grooves 241 and 242 are perpendicular to each other, and the first and second connecting protrusions 224*c* and 234*c* corresponding to the first and second connecting grooves 241 and 242 are also perpendicular to each other. Furthermore, each of the first and second connecting protrusions 224*c* and 234*c* has a section formed substantially in a rectangular shape so that each of the corresponding first and second connecting grooves 241 and 242 also has a section formed substantially in a rectangular shape.

Therefore, the power transmitting member 240, as illustrated in FIG. 7, receives the driving force from the second connecting protrusion 234*c* via two driving points F1 and F2. Also, the power transmitting member 240 transmits the received driving force to the first connecting protrusion 224*c* via two driven points F3 and F4.

Also, there are moving gaps between the first and second connecting grooves 241 and 242 and the first and second connecting protrusions 224*c* and 234*c*, respectively. In detail, a first predetermined moving gap is formed between the first connecting protrusion 224*c* and the first connecting groove 241, and a second predetermined moving gap is formed between the second connecting protrusion 234*c* and the second connecting groove 242 so that the first and second connecting protrusions 224*c* and 234*c* inserted in the first and second rectangular connecting grooves 241 and 242 can move along long sides of the first and second connecting grooves 241 and 242.

That is, as illustrated in FIG. 7, the first connecting protrusion 224*c* can move in A direction inside the first connecting groove 241, and the second connecting protrusion 234*c* can move in B direction inside the second connecting groove 242.

Therefore, even when the second connecting protrusion 234*c* moves in B direction inside the second connecting groove 242, the second connecting protrusion 234*c* can rotate the power transmitting member 240 via the two driving points F1 and F2. Also, even when the first connecting protrusion 224*c* inserted in the first connecting groove 241 moves in A direction thereinside, the first connecting protrusion 224*c* can receive the driving force via the two driven points F3 and F4.

Due to a structure of the power transmitting member 240 as described above, even when the fourth driven member 234 moves in the normal force Fdc direction of the driving force Fdc (see FIG. 1), the second connecting protrusion 234*c* coupled to the shaft 234*b* of the driven member 234 moves only within the second connecting groove 242 so that the movement of the normal force Fdc direction of the fourth driven member 234 is not transmitted to the fourth developing member 224.

Furthermore, when the fourth developing member 224 moves due to contact between the gap ring 270 and the photosensitive medium 110 with non-uniform curvature, the first connecting protrusion 224*c* formed on the shaft 224*b* of the fourth developing member 224 moves in the A direction only within the first connecting groove 241. Therefore, the movement of the fourth developing member 224 is not transmitted to the fourth driven member 234.

The first supporting portion 250 supports opposite shaft portions of the fourth driven member 234 to support the movement of the tangential force Fdt direction of the driving force Fd (see FIG. 1) generated between the fourth driven member 234 and the fourth driving member 134.

The first supporting portion 250, as illustrated in FIG. 6, is provided with a fourth mounting projection 214*a* to project from a side surface of the first supporting portion 250 to be inserted in a fourth mounting rail 124 disposed in the main body 100 of the image forming apparatus.

In the first to third driven members 231, 232, and 233, the movements of the tangential force Fdt direction and the normal force Fdc direction caused by the driving force Fd are relatively small compared with the movement of the fourth driven member 234. Therefore, the first and third driven members 231, 232, and 233, as illustrated in FIG. 9, have first to third mounting projections 211*a*, 212*a*, and 213*a*, to project from side surfaces thereof to be inserted in first to third mounting rails 121, 122, 123, and 124, without separate supporting portions.

However, this does not limit the present general inventive concept. Alternatively, like the power transmitting member 240, all the first to fourth driven members 231, 232, 233, and 234 may have the supporting portion 250.

Also, the first supporting portion 250, as illustrated in FIG. 5, is provided with a first stopping surface 251 to contact a first stopping protrusion 141 formed in the main body 100 of the image forming apparatus to face the tangential force Fdt of the driving force Fd.

As a result, as illustrated in FIG. 5, even when the fourth driven member 234 supported by the first supporting portion 250 moves in the tangential force Fdt direction, the first stopping surface 251 contacts the first stopping protrusion 141, thereby blocking the movement in C direction. At this time, the fourth mounting projection 214*a* contacts the fourth mounting rail 124, thereby blocking the movement of the first supporting portion 250 in E direction.

Also, the first supporting portion 250, as illustrated in FIG. 5, is provided with a second stopping surface 252 to contact a second stopping protrusion 142 formed in the main body 100 of the image forming apparatus to face the elastic pressing force Fb of the elastic member (not illustrated). Therefore, a range within which the first supporting portion 250 can be moved to the photosensitive medium 110 by the elastic pressing force Fb is limited in D direction as illustrated in FIG. 5.

Alternatively, as illustrated in FIG. 6, a second supporting portion 260 to support the fourth developing unit 214 is coupled to the first supporting portion 250. At this time, the first and second supporting portions 250 and 260 are coupled to each other by securing members (not illustrated) such as a screw inserted in a securing hole 253. The second supporting portion 260 supports some portions disposed inside the fourth developing unit 214, for example, an agitator (not illustrated) to agitate developing agent, a supplying roller (not illustrated) to supply the developing agent to the fourth developing member 224, etc.

The first supporting portion 250 is provided with a supporting rail 254 in which a supporting projection 261 to project from the second supporting portion 260 is inserted, and that is formed to be inclined toward the photosensitive medium 110.

Due to the configuration as described above, when the fourth developing unit 214 is pressed toward the photosensitive medium 110 by the elastic pressing force Fb of the elastic member (not illustrated), the first supporting portion 250 may be guided to the photosensitive medium 110 along the supporting rail 254. At this time, the first and second supporting portions 250 and 260 are connected to each other by the supporting rail 254 so that the movement of the first supporting portion 250 is not transmitted to the second supporting portion 260.

Furthermore, even when the first supporting portion 250 moves in the tangential force Fdt direction of the driving force Fd, the first supporting portion 250 may be recovered to an original position toward the photosensitive medium 110 along the supporting rail 254 by the elastic pressing force Fb.

A movement absorbing operation of the developing device of the image forming apparatus according to an exemplary embodiment of the present general inventive concept having the structure as described above will be explained with reference to FIGS. 2 to 9.

Referring to FIGS. 2 to 4, the first to fourth developing units 211, 212, 213, and 214 are disposed to face the photosensitive medium 110 in the main body 100 of the image forming apparatus. At this time, as illustrated in FIG. 2, the fourth driven member 234 of the fourth developing unit 214 disposed near a bottom end of the photosensitive medium 110 moves in the normal force Fdc direction and the tangential force Fdt direction of the driving force Fd as illustrated in FIG. 1 due to a position property thereof.

The movement of the normal force Fdc direction of the driving force Fd of the fourth driven member 234 is absorbed by the power transmitting member 240 disposed between the fourth driven member 234 and the fourth developing member 224 as illustrated in FIG. 7.

In detail, when the fourth driven member 234 moves in the normal force Fdc direction of the driving force Fd during operation, the second connecting protrusion 234*c* to project from the fourth driven member 234 moves in the B direction within the second connecting groove 242 of the power transmitting member 240. At this time, the fourth developing member 224 is not coaxially connected with the fourth driven member 234 and receives the driving force from the first connecting protrusion 224*c* inserted in the first connecting groove 241 formed on a first surface 240*a* of the power transmitting member 240 so that the B direction movement of the second connecting protrusion 234*c* is not transmitted to the fourth developing member 224.

Alternatively, when the fourth developing member 224 moves during operation, the first connecting protrusion 224*c* formed on the shaft 224*b* of the fourth developing member 224 moves in the A direction within the first connecting groove 241 of the power transmitting member 240 so that the movement of the fourth developing member 224 is not transmitted to the fourth driven member 234.

Therefore, even when the fourth developing member 224 and the fourth driven member 234 move in the normal force Fdc direction of the driving force Fd, the power transmitting member 240 can absorb the movement, and, at the same time, transmit the driving force of the fourth driven member 234 to the fourth developing member 224.

Furthermore, when the fourth driven member 234 is moved to the bottom end of the photosensitive medium 110 by the tangential force Fdt, which is generated as the fourth driven member 234 is driven in Fd direction as illustrated in FIGS. 5 to 8, the first supporting portion 250 to support the fourth driven member 234 blocks the movement.

In detail, as illustrated in FIG. 5, the first supporting portion 250 is interfered with the first stopping protrusion 141 so that the tangential force Fdt direction movement generated by the driving force Fd of the fourth driven member 234 is limited in the C direction. Also, the fourth mounting projection 214*a* formed on the side surface of the first supporting portion 250 is interfered with an inner wall of the fourth mounting rail 124 in the E direction.

Also, the first and second supporting portions 250 and 260 are connected with each other via the supporting projection 261 inserted in the supporting rail 254 so that when the first supporting portion 250 is pressed to the photosensitive medium 110 by the elastic pressing force Fb, the second supporting portion 260 does not move.

When the fourth driven member 234 moves due to the driving force Fd generated between the fourth driven member 234 and the fourth driving member 134, the power transmitting member 240 and the first supporting portion 250 can absorb the movement so that the movement is not transmitted to the fourth developing unit 214.

Alternatively, in this exemplary embodiment, the fourth driven member 234 is driven in the counterclockwise direction and is limited that the fourth driven member 234 moves to the bottom end of the photosensitive medium 110 due to the tangential force Fdt of the driving force Fd. However, this should not be considered as limiting. Alternatively, another exemplary embodiment of the present general inventive concept can limit the movement generated when the driven member rotates in the clockwise direction. In this case, instead of the fourth driven member 234, the first driven member 231 disposed near a top end of the photosensitive medium 110 may be provided with the first supporting portion 250 with the structure as described above.

The power transmitting unit according to an exemplary embodiment of the present general inventive concept, and the developing device and the image forming apparatus having the same have the power transmitting member with connecting grooves that are formed to be perpendicular to each other on opposite side surfaces thereof and to which the driven member and the developing member are connected, respectively, so that the normal force direction movement generated by the driving force between the driven member and the driving member can be absorbed. As a result, the movement generated between the driven member and the driving member is not transmitted to the developing member so that the developing nip between the developing member and the photosensitive medium may be uniformly maintained. Therefore, image quality is increased.

Also, the first supporting portion to support the tangential force direction movement generated by the driving force between the driven member and the driving member is provided so that the movement of the tangential force direction of the driving force of the driven member may be blocked.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A developing device, comprising:

a developing member disposed in a developing unit to supply developing agent to a photosensitive medium;

a driven member to receive power from a driving member and to allow the developing member to rotate;

a power transmitting member to connect the developing member and the driven member, and to absorb a movement of a normal force direction of a driving force generated between the driving member and the driven member; and a first supporting portion to support opposite shaft portions of the driven member to support a movement of the driven member caused by a tangential force of the driving force generated between the driven member and the driving member.

2. The developing device of claim 1, wherein the power transmitting member comprises a coupler having first and second connecting grooves formed to intersect each other on first and second surfaces thereof, and first and second connecting protrusions formed on a shaft of the developing member and a shaft of the driven member are inserted in the first and second connecting grooves.

3. The developing device of claim 2, wherein the first and second connecting grooves and the first and second connecting protrusions comprises:

a section formed substantially in a rectangular shape.

4. The developing device of claim 3, wherein the first and second connecting grooves are perpendicular to each other.

5. The developing device of claim 4, wherein predetermined moving gaps are formed between the first and second connecting protrusions and the first and second connecting grooves.

6. The developing device of claim 1, wherein the developing unit is mounted along a mounting rail disposed in a main body, and is biased to the photosensitive medium by an elastic member.

7. The developing device of claim 6, wherein a mounting projection inserted in the mounting rail is formed on a side surface of the first supporting portion.

8. The developing device of claim 7, wherein the first supporting portion comprises:

a first stopping surface to contact a first stopping protrusion formed in the main body to face the tangential force of the driving force; and a second stopping surface to contact a second stopping protrusion formed in the main body to face an elastic pressing force of the elastic member.

9. The developing device of claim 8, further comprising:

a second supporting portion to support the developing unit and be connected with the first supporting portion.

10. The developing device of claim 9, wherein the first supporting portion comprises:

a supporting rail in which a supporting projection to project from the second supporting portion is inserted, and the supporting rail formed to be inclined to the photosensitive medium.

11. An image forming apparatus, comprising:

a main body in which a photosensitive medium is disposed; and a developing device detachably disposed at the main body to develop electrostatic latent images on the photosensitive medium; the developing device comprises:

a developing member disposed in a developing unit to supply developing agent to the photosensitive medium;

a driven member to receive power from a driving member and allow the developing member to rotate;

a power transmitting member to connect the developing member and the driven member, and to absorb a movement of a normal force direction of a driving force generated between the driving member and the driven member; and a first supporting portion to support opposite shaft portions of the driven member to support a movement of the driven member caused by a tangential force of the driving force generated between the driven member and the driving member.

12. The image forming apparatus of claim 11, wherein the power transmitting member comprises a coupler having first and second connecting grooves formed to intersect each other on first and second surfaces thereof, and first and second connecting protrusions formed on a shaft of the developing member and a shaft of the driven member are inserted in the first and second connecting grooves.

13. The image forming apparatus of claim 12, wherein the first and second connecting grooves and the first and second connecting protrusions comprise:

a section formed substantially in a rectangular shape.

14. The image forming apparatus of claim 13, wherein the first and second connecting grooves are perpendicular to each other.

15. The image forming apparatus of claim 14, wherein predetermined moving gaps are formed between the first and second connecting protrusions and the first and second connecting grooves.

16. The image forming apparatus of claim 11, wherein the developing unit is mounted along a mounting rail disposed in a main body, and is biased to the photosensitive medium by an elastic member.

17. The image forming apparatus of claim 16, wherein a mounting projection inserted in the mounting rail is formed on a side surface of the first supporting portion.

18. The image forming apparatus of claim 17, wherein the first supporting portion comprises:

a first stopping surface to contact a first stopping protrusion formed in the main body to face the tangential force of the driving force; and a second stopping surface to contact a second stopping protrusion formed in the main body to face an elastic pressing force of the elastic member applied substantially perpendicularly to the first stopping surface.

19. The image forming apparatus of claim 17, wherein the first supporting portion comprises:

a first stopping surface to contact a first stopping protrusion formed in the main body to face the tangential force of the driving force; and a second stopping surface to contact a second stopping protrusion formed in the main body to face an elastic pressing force of the elastic member.

20. The image forming apparatus of claim 19, further comprising:

a second supporting portion to support the developing unit and be connected with the first supporting portion.

21. The image forming apparatus of claim 20, wherein the first supporting portion comprises:

a supporting rail in which a supporting projection projecting from the second supporting portion is inserted, and the supporting rail formed to be inclined to the photosensitive medium.

* * * * *